US008152505B1

(12) United States Patent
Mesmer

(10) Patent No.: US 8,152,505 B1
(45) Date of Patent: Apr. 10, 2012

(54) ROTARY EXPANSIBLE CHAMBER DEVICE

(76) Inventor: James Mesmer, Tulsa, OK (US)

( * ) Notice: Subject to any disclaimer, the term of this patent is extended or adjusted under 35 U.S.C. 154(b) by 542 days.

(21) Appl. No.: 12/363,262

(22) Filed: Jan. 30, 2009

(51) Int. Cl.
*F03C 2/00* (2006.01)
*F03C 4/00* (2006.01)
*F04C 2/00* (2006.01)

(52) U.S. Cl. ..... 418/150; 418/168; 418/255; 418/257; 123/246

(58) Field of Classification Search ..... 418/253–255, 418/150, 168, 107–109; 123/243–246
See application file for complete search history.

(56) References Cited

U.S. PATENT DOCUMENTS 1,753,476 A * 4/1930 Richer ..... 418/168
2,013,916 A 9/1935 Jackson
2,015,307 A 9/1935 Hand
2,068,570 A * 1/1937 Ross ..... 418/257
RE22,160 E * 8/1942 Davis ..... 418/255
2,306,276 A 12/1942 Nash
2,353,965 A * 7/1944 Meador ..... 418/255
3,213,803 A * 10/1965 Meyer ..... 418/255
3,988,080 A 10/1976 Takada
4,451,220 A * 5/1984 Ito et al. ..... 418/255
4,484,873 A 11/1984 Inagaki et al.
5,640,938 A * 6/1997 Craze ..... 418/255
7,185,625 B1 * 3/2007 Guan et al. ..... 123/246

* cited by examiner

*Primary Examiner* — Theresa Trieu
(74) *Attorney, Agent, or Firm* — Gable Gotwals

(57) ABSTRACT

A rotary expansible chamber device includes intersecting, two-piece vanes that provide expansion/compression chambers as the vanes rotate about a central axis of a rotor housing. The rotor housing has an inner contour defined by a conchoid of rhodonea having a shape coefficient of at least 3. The vanes are captured by a primary and secondary output shaft, with engagement arms of the primary output shaft being juxtaposed between the intersecting vanes. A vane spring helps maintain each vane at a constant length and in sealing engagement with the inner contour of the rotor housing.

20 Claims, 8 Drawing Sheets

ROTARY EXPANSIBLE CHAMBER DEVICE

BACKGROUND OF THE INVENTION

1. Field of Invention

The invention relates primarily to internal combustion engines of the rotary type. This invention is also related on a secondary level to rotary pumps, compressors, and vacuums.

2. Description of Related Art

There is a multitude of rotary engines that vary greatly in design and practicality. However, most of these engines have failed to make any significant impact in the internal-combustion engine industry. The only commercially successful rotary engine was the Wankel design that utilized an eccentrically mounted triangular rotor that rotated within an epitrochoid-shaped rotor housing. This design helped to reduce engine vibration and minimize the overall number moving parts but was less efficient than the more common piston engine. Other rotary engine designs have sought to address the shortcomings of the Wankel engine but none have been successfully introduced into the internal-combustion engine market.

The reciprocating piston engine has its problems as well. Its linear to rotational motion combined with its many moving parts makes it prone to mechanical failure. The frictional resistance of its moving parts also reduces its thermodynamic efficiency. It is likely that the reciprocating piston engine has reached its apex in terms of performance, thus a new internal-combustion technology is needed.

BRIEF SUMMARY OF THE INVENTION

A rotary apparatus includes a static rotor housing having a cover with ports, a vane assembly housed within the static rotor housing; and an output shaft in communication with the vane assembly. The vane assembly is an intersecting vane assembly. A plurality of engagement arms extend upwardly from a flange of the output shaft and each engagement arm is juxtaposed between a portion of the intersecting vanes so that the vane assembly and output shaft rotate together. The engagement arms may connect to a second output shaft.

The static rotor housing has an inner contour defined by a conchoid of rhodonea with a shape coefficient "c", where "c" is an odd integer value having a minimum magnitude of 3. The number of intersecting vanes may be less than, greater than, or equal to "c", depending on the desired power strokes per revolution. The rotor housing may also include one or more ports.

Each of the intersecting vanes includes a vane tip portion at each end having a height "$H_V$". As the intersecting vanes rotate about a central axis of the rotor housing, the intersecting vanes are encompassed within a cylinder-shaped envelope having a height equal to the height "$H_V$". The height "$H_V$" is substantially equal to a depth "D" of the rotor housing. Depth "D" is selected to provide a desired displacement. The diameter and eccentricity of the rotor housing, the width "$W_V$" of each intersecting vane, and the distance "$D_A$" between opposing engagement arms are selected to provide a desired compression ratio.

Each of the intersecting vanes has a constant length "L". The length "L" allows the vane tip portion to maintain a sealing engagement with the inner contour of the rotor housing as the respective intersecting vane rotates about the central axis of the rotor housing. Each vane is preferably a two-part vane, and each vane half or section may have a L-shape or T-shape depending on whether the vane is a middle vane or an outer vane. A vane spring located between the opposing vane sections helps the vane to maintain sealing engagement with the inner contour of the rotor housing. A vane guide located between the vane sections helps the vane maintain proper alignment during rotation.

It is an objective of this invention to create a rotary expansible chamber device capable of internal-combustion as well as pumping operations which utilizes an intersecting vane assembly in accordance with a rotor housing to create maximum and minimum volumes for various gas cycles involving compression and expansion.

It is another objective of this invention to create a rotary engine that improves the internal combustion engine in a variety of areas. This invention is intended to improve the fuel efficiency of the internal combustion engine, to improve its reliability, to reduce its weight, to increase its power density, and to reduce its overall pollution output.

It is also an objective of this invention to create a rotary expansible chamber device capable of working as an internal-combustion engine, a steam engine, a compressed air engine, a fluid pump, a compressor, or a vacuum.

Yet another objective of this invention is to create a more fuel efficient engine by improving the combustion characteristics of the rotary engine, reducing frictional resistance by decreasing the number of moving parts, utilizing efficiency maximizing gas cycles, and reducing engine weight.

Finally, it is an objective of this invention to create an engine that improves reliability by reducing the number of parts, especially the number of moving parts, by constructing a true rotary engine that virtually eliminates the damaging linear motions associated with the reciprocating piston engine.

A better understanding of the rotary apparatus will be obtained from the following detailed description of the preferred embodiments taken in conjunction with the drawings and the attached claims.

DETAILED DESCRIPTION OF THE PREFERRED EMBODIMENTS

Figure 1:
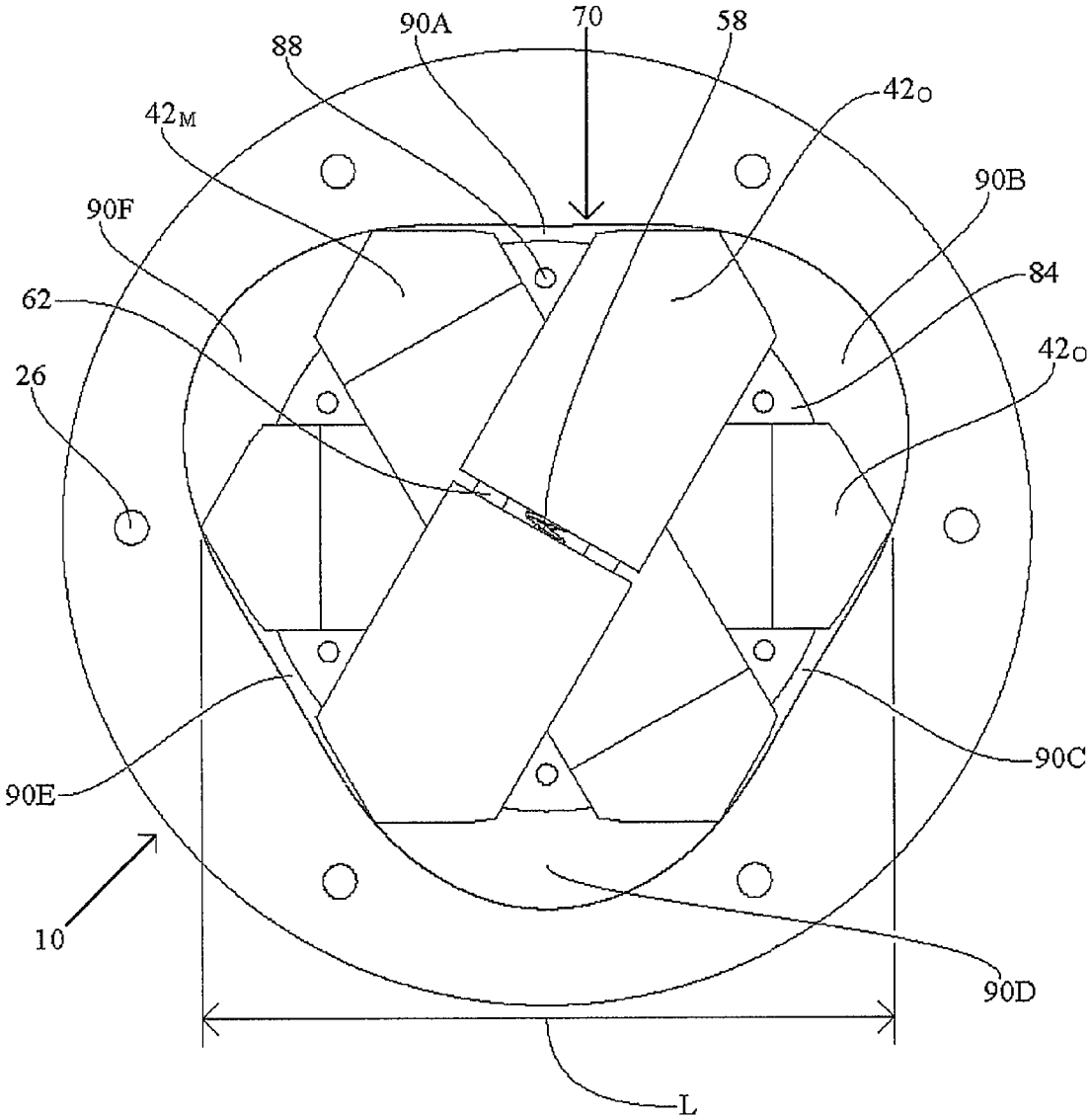
FIG. 1 is a partial cross-sectional side view of the rotor assembly within the rotor housing.
Figure 2:
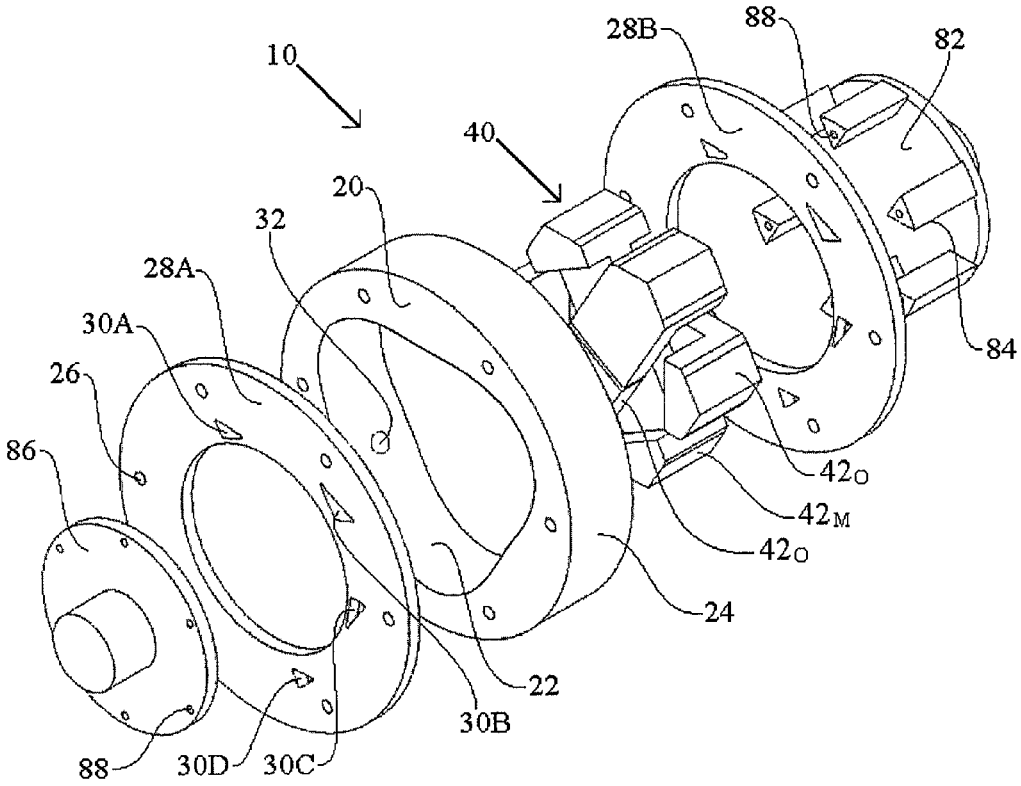
FIG. 2 is an exploded perspective view of the engine and its components.

The structure and operation of the preferred embodiments of a rotary engine will be described with reference to the various labeled elements shown in the drawings and referred to by the following numbers:

| | |
|---|---|
| 10 | Rotary engine |
| 20 | Rotor housing |
| 22 | Inner contour |
| 24 | Outer contour |
| 26 | Bolt hole |

-continued

| | |
|---|---|
| 28 | Side cover |
| 30 | Inlet or outlet port |
| 32 | Additional port |
| 40 | Vane assembly |
| 42 | Vane |
| 44 | First vane section |
| 46 | Opposing vane section |
| 48 | First end |
| 50 | Second end |
| 52 | Vane tip portion |
| 54 | Upper surface |
| 56 | Opposing lower surface |
| 58 | Vane spring |
| 60 | Spring recess |
| 62 | Vane guide |
| 64 | Guide recess |
| 70 | Rotor assembly |
| 80 | Output shaft assembly |
| 82 | Primary output shaft |
| 84 | Engagement arm |
| 86 | Secondary output shaft |
| 88 | Bolt hole |
| 90 | Chamber |

Referring first to FIGS. 1 to 4, rotary engine 10 may be classified as a rotary expansible chamber device, as an internal-combustion engine, or as a pump. Rotary engine 10 includes a rotor housing 20, an intersecting vane assembly 40, and an output shaft assembly 80. Output shaft assembly includes a primary output shaft 82 and a secondary output shaft 86. In a preferred embodiment, intersecting vane assembly 40 provides six separate chambers 90A-F within rotor housing 20. The chambers 90A-F are defined by intersecting vane assembly 40, the inner contour 22 of rotor housing 20, and a set of engagement arms 84 of primary output shaft 82.

To provide six separate chambers 90A-F, intersecting vane assembly 40 includes three vanes 42, namely, two outer vanes $\mathbf{42}_O$ and one middle vane $\mathbf{42}_M$. In a preferred embodiment, each vane 42 is a two-piece vane having a first vane section 44 and an opposing vane section 46. Vane assembly 40 rotates as a unit along with output shaft assembly 80. A set of engagement arms 84 extending from primary output shaft 82 are configured so that each vane section 44, 46 resides between the engagement arms 84 of primary output shaft 82. In a preferred embodiment, engagement arms 84 are triangular-shaped engagement arms. An apex of a triangular-shaped vane tip portion 52 of each vane section 44, 46 contacts (and maintains contact with) the inner contour 22 of rotor housing 20 as rotary engine 10 cycles.

Vane assembly 40 in conjunction with the primary and secondary output shafts 82, 86 forms the rotor assembly 70. As rotor assembly 70 rotates within rotor housing 20, the maximum and minimum volumes necessary for gas cycles to take place occur within each of the six combustion chambers 90A-F. Because only four chambers 90 are necessary for a four-stroke process to take place, two extra chambers 90 are provided in a three vane 42 arrangement. These extra chambers 90 may be used together as a built-in air compressor.

Referring now to FIGS. 3 to 7, the inner or middle vane $\mathbf{42}_M$ and the two outer vanes $\mathbf{42}_O$ are each composed of opposing vane sections 44, 46, a vane spring 58, and vane guides 62. Each vane section 44, 46 has a squared first end 48 and an opposing second end 50. A triangular-shaped vane tip portion 52 is at the second end 50. Each vane tip portion 52 has a height "$H_V$" that is substantially equal to a depth "D" of rotor housing 20. Engagement arms 84 also have a height "$H_A$" preferably substantially equal to "$H_V$". Depth "D" and other shape parameters of rotor housing 20 are preselected to provide the desired performance characteristics of rotary engine 10. For example, depth "D' may be determined in part by the desired displacement. The diameter and eccentricity of inner contour 22 may be determined in part by the desired compression ratio. The end-to-end distance "$D_A$' of opposing engagement arms 84 also affects the compression ratio, as does the width "$W_V$" of the vanes 42. When assembled into intersecting vane assembly 40 within rotor housing 20, the upper and lower surfaces 54, 56 of each vane tip portion 52 and the surfaces 54, 56 of an adjacent vane tip portion 52 are co-planar surfaces.

Vane sections $\mathbf{44}_O$, $\mathbf{46}_O$ are L-shaped vane sections. Vane sections $\mathbf{44}_M$, $\mathbf{46}_M$ are T-shaped vane sections. Each vane section 44, 46 includes recesses 60, 64 for receiving a vane spring 58 and vane guides 62, respectively. The vane tips 52 are able to maintain sealing engagement with the inner contour 22 of the rotor housing 20 by means of vane spring 58. Vane spring 58 helps maintain vane 42 at a constant length "L" as the vane assembly 40 rotates. See e.g., FIGS. 1, 6 & 7. The vane guides 62 help to prevent each vane 42 from shifting while rotor assembly 70 is in motion.

Figure 3:
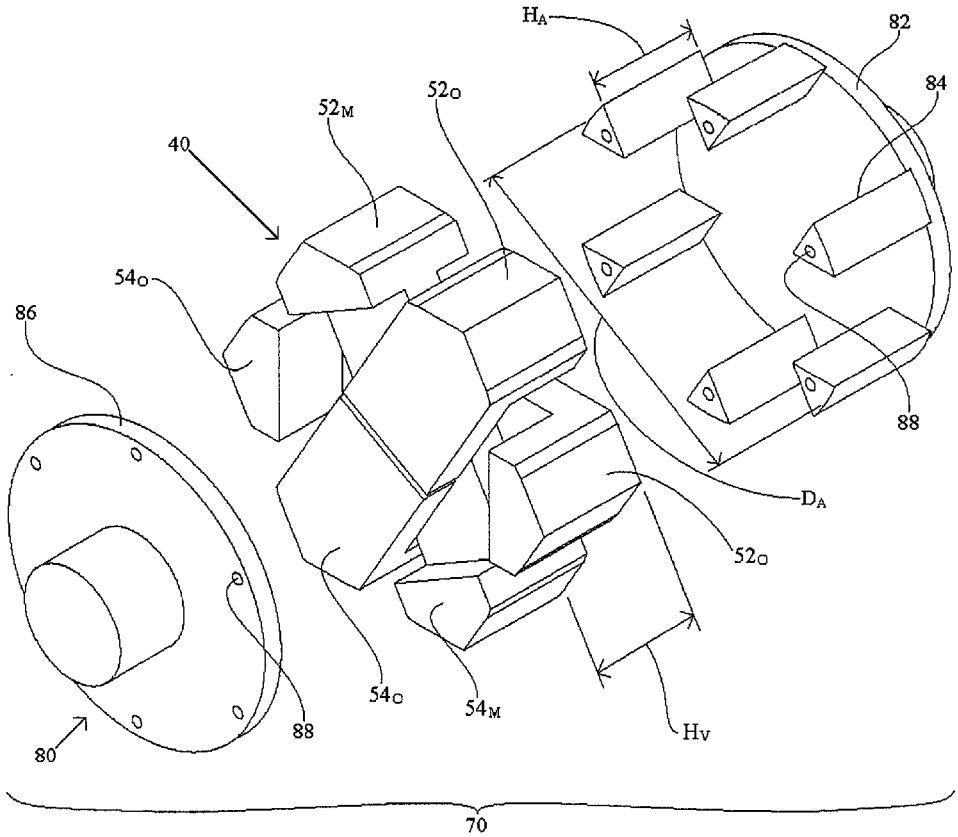
FIG. 3 is a partially exploded view of the rotor assembly including the vane assembly.
Figure 4:
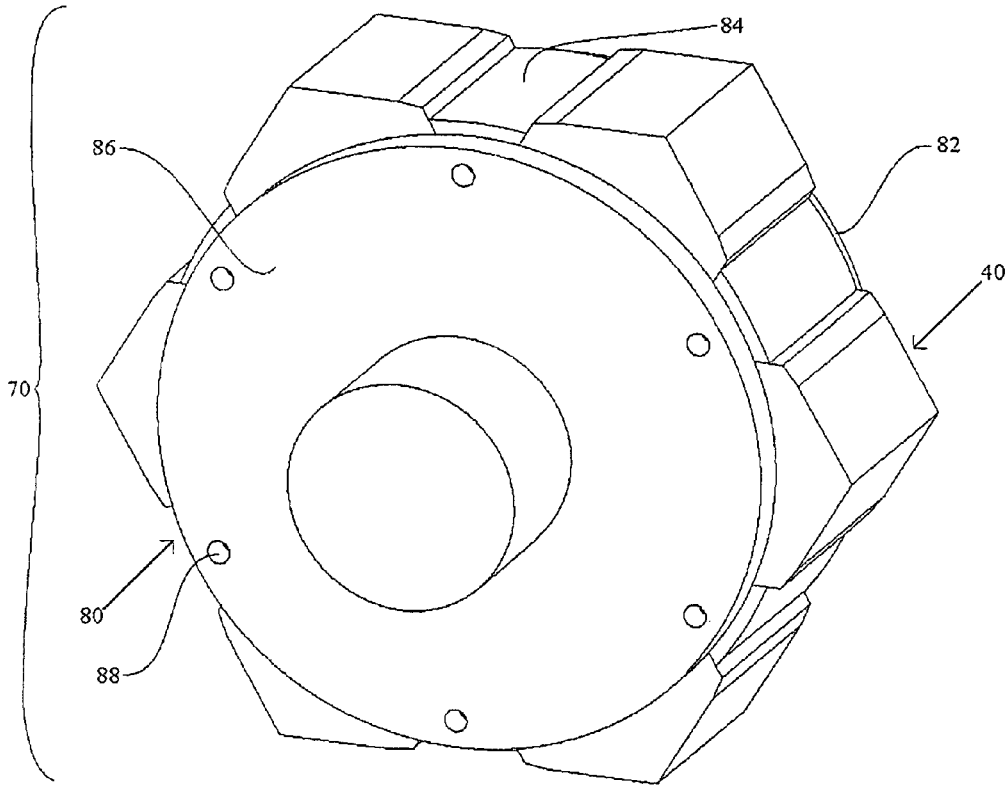
FIG. 4 is a perspective view of the rotor assembly.
Figure 5:
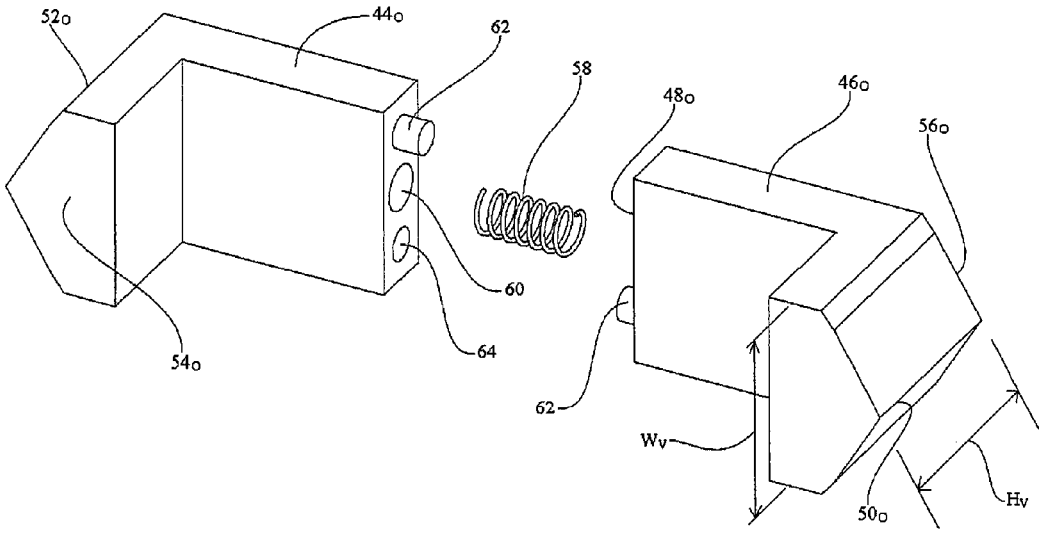
FIG. 5 is an exploded perspective view of an outer vane.
Figure 6:
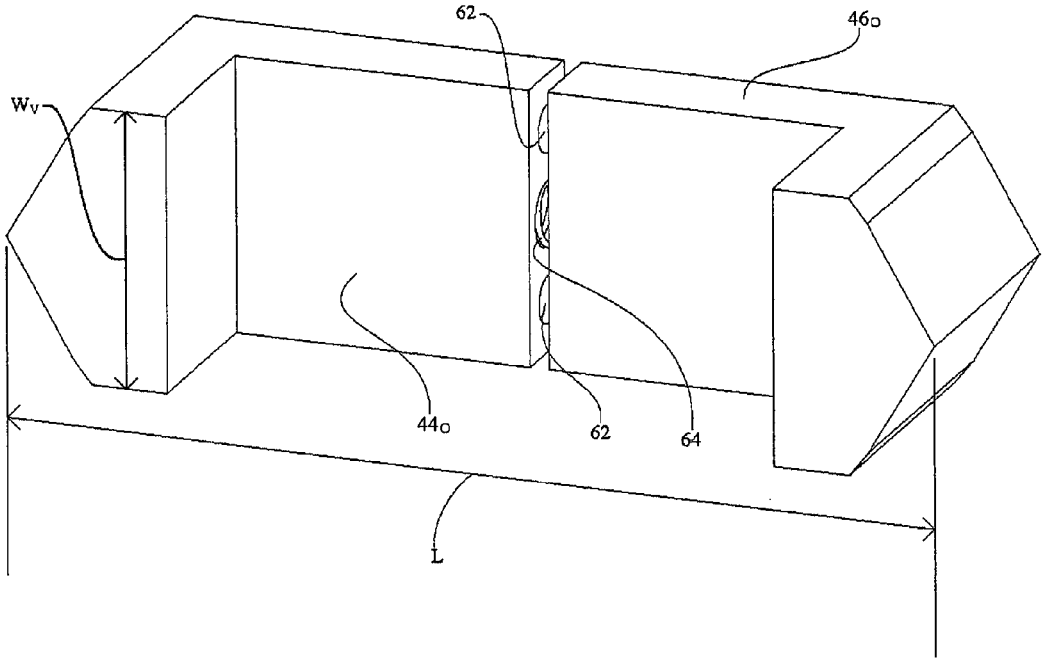
FIG. 6 is a perspective view of an outer vane.
Figure 7:
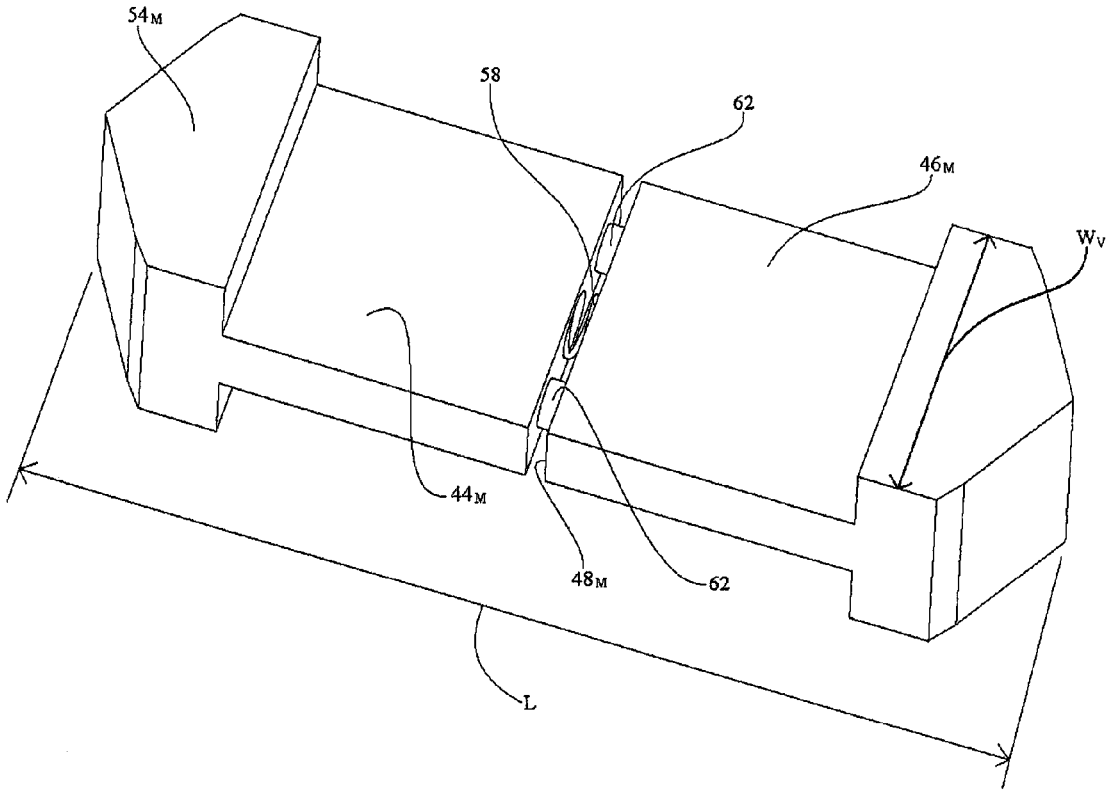
FIG. 7 is an exploded perspective view of an inner or middle vane.
Figure 9:
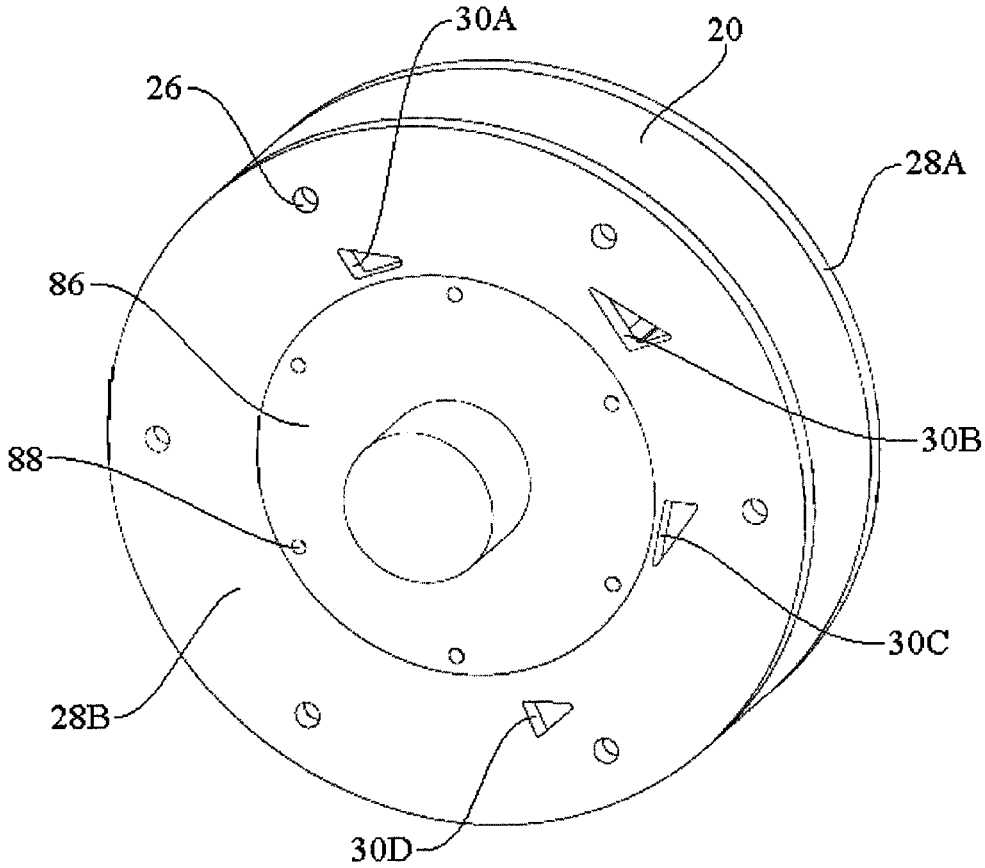
FIG. 9 depicts the fully assembled rotary engine.

As shown in FIGS. 3 & 4, primary output shaft 82 contains the three vanes 42 and the secondary output shaft 86 is connected to primary output shaft 82, thereby forming rotor assembly 70. Bolts (not shown) are then slotted through the output shaft bolt holes 88 to hold rotor assembly 70 together. Rotor assembly 70 resides within rotor housing 20 and is sealed by side covers 28A, 28B. See FIGS. 2 & 9. Bolts (not shown) are then slotted through the rotor housing bolt holes 26 to hold together all the components of engine 10. Rotor assembly 70 may contain any ports necessary including those for lubrication.

Figure 8:
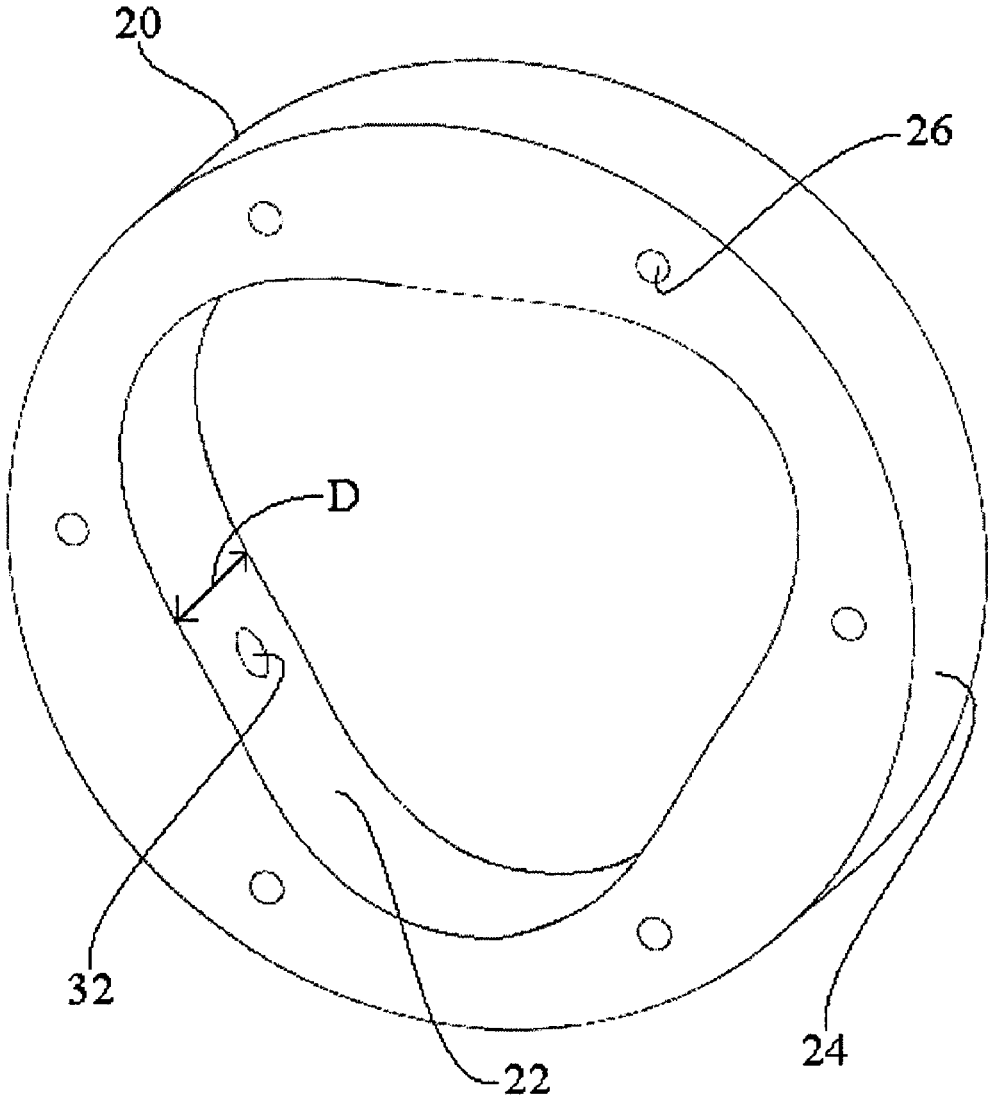
FIG. 8 is a perspective view of the rotor housing.

Referring now to FIG. 8, rotor housing 20 is formed by an inner contour 22 and an outer contour 24. Outer contour 24 may be of any shape preferable so long as it fully contains inner contour 22. In a preferred embodiment, inner contour 22 is defined by the conchoid of rhodonea, shown below in polar form (Eq. 1) and parametric form (Eq. 2):

$$r=a+b\sin(c\theta) \quad \text{(Eq. 1)}$$

$$x=a\cos(t)+b\sin(ct)\cos(t)$$

$$y=a\sin(t)+b\sin(ct)\sin(t) \quad \text{(Eq. 2)}$$

where

"a" is the diameter coefficient with its magnitude defining the radius of the inner contour 22;

"b" is the eccentricity coefficient with its magnitude defining the slope or rate of "petal" curvature of the inner contour 22; and "c" is the shape coefficient with its magnitude defining the number of "petals" of inner contour 22.

The conchoid of rhodonea provides an eccentric, petal-like shape to inner contour 22. In a preferred embodiment, the diameter coefficient "a" is equal to 5 inches, the deformation coefficient "b" is equal to 0.6 inches, and the shape coefficient "c" is equal to 3. "D" is equal to 3 inches. To provide a constant diameter to inner contour 22, the magnitude of "c" must be an odd integer value. This allow the vanes 42 to maintain a constant length "L" as they rotate and slide about the central axis of the inner contour 22. See FIGS. 1, 6 & 7. Length "L" is equal to twice the magnitude of "a".

If "c" is an integer value, the number of "petals" of inner contour 22 equals the magnitude of "c". The number of intersecting vanes 42 may be less than, equal to, or greater than the magnitude of "c" depending on the number of desired power strokes per revolution. As the number of intersecting vanes 42 increases, the power density of rotary engine 10 increases (and vice versa). When the number of intersecting vanes equals the magnitude of "c", the number of chambers 90 provided is twice the magnitude of "c". In addition, the number of engagement arms 84 is also twice the magnitude of "c". For example, if c=5 and five intersecting vanes 42 are employed, rotary engine 10 will include ten chambers 90 and ten engagement arms 84 juxtaposed between adjacent vane sections 44, 46.

Rotor housing 20 may contain a spark plug or glow plug port 32 and any necessary ports for intake, exhaust, lubrication, and cooling. Rotor housing 20 may also contain bolt holes 26. The side covers 28A, 28B may also contain the inlet and outlet ports 30A-D for gas intake and exhaust and any necessary ports for cooling and lubrication.

All the parts listed above act either statically or in motion to create the fully assembled invention. Rotary engine 10 may operate as an internal-combustion engine capable of running under a variety of thermodynamic cycles. As mentioned previously, rotary engine 10 may also use the two extra chambers 90 as a compressor to boost power output and efficiency. The compressed air may also be diverted outside of rotary engine 10 to a fuel or air intake chamber 90 (e.g., 90 B, D & F). Last, rotary engine 10 may operate as a pump or a vacuum. This may be achieved by providing the necessary inlet and outlet ports 30.

While a rotary engine has been described with a certain degree of particularity, many changes may be made in the details of construction and the arrangement of components without departing from the spirit and scope of this disclosure. A rotary engine made according to this disclosure, therefore, is not limited to the embodiments set forth herein, but is limited only by the scope of the attached claims, including the full range of equivalency to which each element thereof is entitled.

What is claimed is:

1. A rotary apparatus comprising:

a static rotor housing including a cover having at least two ports;

a vane assembly housed within the static rotor housing; and an output shaft in communication with the vane assembly and having a plurality of engagement arms extending upwardly from a flange of the output shaft;

the vane assembly including a plurality of intersecting vanes, a portion of each engagement arm juxtaposed between a portion of the intersecting vanes so that the vane assembly and output shaft rotate together, the static rotor housing having an outer contour and an inner contour, the inner contour being defined by a conchoid of rhodonea, the conchoid of rhodonea being expressed in polar form as $r=a+b\sin(c\Theta)$, where "r" is a radius of the inner contour, $\Theta$ is a polar angle of a curvature of the inner contour, "a" is a diameter of the inner contour, "b" is an eccentricity coefficient defining a rate of curvature of the inner contour, and "c" is an odd integer value at least equal to 3 in magnitude.

2. A rotary apparatus according to claim 1 further comprising a number of vanes in the plurality of intersecting vanes being equal to "c".

3. A rotary apparatus according to claim 1 further comprising a number of vanes in the plurality of intersecting vanes being less than "c".

4. A rotary apparatus according to claim 1 further comprising each of the intersecting vanes having a length "L" effective for a vane tip portion to maintain a sealing engagement with the inner contour of the rotor housing as each intersecting vane rotates coaxially within the rotor housing.

5. A rotary apparatus according to claim 1 further comprising each of the intersecting vanes having a vane tip portion at each end, each vane tip portion having a height "$H_V$", the intersecting vanes being encompassed within a cylinder-shaped envelope having a height equal to the height "$H_V$" as the intersecting vanes rotate coaxially within the rotor housing.

6. A rotary apparatus according to claim 5 further comprising the height "$H_V$" being substantially equal to a depth "D" of the rotor housing.

7. A rotary apparatus according to claim 1 further comprising the intersecting vanes each having a first vane section and an opposing vane section, each vane section having a first end and a second end, the first ends being located opposite each other, the second ends lying opposite the inner contour of the rotor housing.

8. A rotary apparatus according to claim 7 further comprising each of the intersecting vanes including a vane spring located between the opposing first ends.

9. A rotary apparatus according to claim 8 further comprising the vane spring being effective for maintaining sealing engagement of each second end with the inner contour of the rotor housing as the respective intersecting vane rotates coaxially within the rotor housing.

10. A rotary apparatus according to claim 7 further comprising a vane guide located between the opposing first ends.

11. A rotary apparatus according to claim 10 further comprising the vane guide being effective for providing alignment of the first and the opposing vane sections as the vane rotates coaxially within the rotor housing.

12. A rotary apparatus according to claim 7 further comprising at least one of the first vane section and the opposing vane section being an L-shaped vane section.

13. A rotary apparatus according to claim 7 further comprising at least one of the first vane section and the opposing vane section being a T-shaped vane section.

14. A rotary apparatus according to claim 1 further comprising a secondary output shaft.

15. A rotary apparatus according to claim 14 further comprising at least one of the engagement arms being connectable to the secondary output shaft.

16. A rotary apparatus according to claim 1 further comprising the rotor housing including at least one port.

17. A rotary apparatus according to claim 1 further comprising the rotor housing having a preselected depth "D" effective for providing a desired displacement.

18. A rotary apparatus according to claim 1 further comprising the inner contour of the rotor housing having a preselected radius of magnitude "a" and preselected eccentricity of magnitude "b" effective for providing a desired compression ratio.

19. A rotary apparatus according to claim 1 further comprising a preselected distance "$D_A$" between opposing pairs of engagement aims in the plurality of engagement arms effective for providing a desired compression ratio.

20. A rotary apparatus according to claim 1 further comprising each vane in the plurality of intersecting vanes having a width "$W_V$" effective for providing a desired compression ratio.

* * * * *